US005985773A

United States Patent [19]

Lee

[11] Patent Number: 5,985,773

[45] Date of Patent: Nov. 16, 1999

[54] FABRIC FOR TENTS AND A PROCESS FOR PREPARING THE SAME

[76] Inventor: Youn Jae Lee, 228-2 Kueui-dong, Kwangjin-ku, Seoul, Rep. of Korea

[21] Appl. No.: 09/003,552

[22] Filed: Jan. 6, 1998

[30] Foreign Application Priority Data

Jul. 25, 1997 [KR] Rep. of Korea ..... 97-34929

[51] Int. Cl.[6] ..... B32B 27/04; B32B 27/12

[52] U.S. Cl. ..... 442/89; 442/79; 442/83; 442/85; 442/131; 442/144; 442/145; 442/168; 442/164

[58] Field of Search ..... 442/83, 85, 89, 442/131, 144, 145, 168, 164

[56] References Cited

U.S. PATENT DOCUMENTS

| | | | |
|---|---|---|---|
| 3,360,394 | 12/1967 | Griffin et al. | 117/63 |
| 3,864,156 | 2/1975 | Weil | 117/136 |
| 4,554,198 | 11/1985 | Von Bliicher et al. | 428/143 |
| 4,560,611 | 12/1985 | Naka et al. | 428/266 |
| 4,594,286 | 6/1986 | McKinney et al. | 428/245 |
| 4,707,400 | 11/1987 | Towery | 428/260 |
| 4,714,650 | 12/1987 | Obayashi et al. | 428/265 |
| 4,774,131 | 9/1988 | Dahman et al. | 428/286 |
| 4,861,651 | 8/1989 | Goldenhersh | 428/255 |
| 4,869,953 | 9/1989 | Watson et al. | 428/260 |
| 4,910,078 | 3/1990 | Hill et al. | 428/290 |
| 5,252,387 | 10/1993 | Samson et al. | 428/248 |
| 5,283,112 | 2/1994 | Krishnan | 428/261 |
| 5,389,430 | 2/1995 | Yilgor et al. | 428/246 |
| 5,583,047 | 12/1996 | Blinka et al. | 436/5 |

OTHER PUBLICATIONS http://www.worldyellowpages.com/alumin.htm.

*Primary Examiner*—Marion McCamish
*Assistant Examiner*—Arti R. Singh
*Attorney, Agent, or Firm*—Philip Summa

[57] ABSTRACT

A fabric for tents consisting a gray woven from nylon or polyester filaments and a layer of coating composition including polyurethane, a pigment, an ultraviolet inhibitor, aluminum powders, ceramic powders, a fire retardant agent and a solvent can be protected from a yellowing appearance caused by ultraviolet rays and has a preferable color. The lifetime of the fabric can be extended. And the comparative low cost and short time are necessary for the process for preparing the fabric.

6 Claims, 3 Drawing Sheets

FABRIC FOR TENTS AND A PROCESS FOR PREPARING THE SAME

BACKGROUND OF THE INVENTION (a) Field of the Invention

The present invention relates to a fabric for tents and a process for preparing the same, particularly to a fabric consisting of a gray woven from nylon or polyester filaments and a layer of coating composition including polyurethane as a main component and an additional pigment, an ultraviolet inhibitor, aluminum powders, ceramic powders, a fire retardant agent and a solvent. The fabric can be protected from a yellowing appearance caused by ultraviolet rays and has a preferable color. The lifetime of the fabric can be extended. The process for preparing the fabric can be carried out at comparative low cost and short time periods.

(b) Description of the Related Art

Nowadays, demand for tents is increasing continuously because camping, hiking, etc. are becoming more widespread as leisure activities or outdoor sports. Additionally, the fabrics for tents are used widely for various events. It is desirable that fabric used in tents be resistant to water, fire, and ultraviolet sunlight. In the aspects of dyeing properties, cost and physical strength, fabrics prepared with nylon grays represent the main portion of fabrics for tents. Fabrics prepared with polyester and cotton grays are used in comparatively smaller amounts.

Compared with FIGS. 2 and 4, a general process for preparing a fabric for tents prepared with nylon grays is described below.

A gray is prepared from nylon filaments through a sizing process. It will be understood that as used herein, the term "gray" refers to an unfinished fabric just off of a loom or knitting machine, and that the spellings "greige" and "grey" are also used in this art with the same meaning. After the sizing process, the gray is scoured from sizing agents and other contaminants through a scouring process, and dyed in a dyeing process. The dyeing process for dyeing the fabric for tents is a lengthy process requiring approximately 18 hours. Furthermore, the dyeing process contaminates water used in the washing process. Because of factors such as ultraviolet resistance, shrinkage, heat resistance, etc., nylon has been widely used for grays because nylon has superior dyeing properties to polyester. For example, a nylon gray can be dyed through a low temperature dyeing process performed at below 100° C., but a polyester gray has to be dyed through a high temperature dyeing process performed at above 120° C. or through a carrier dyeing process. Therefore, cost of dyeing polyester gray is typically higher than the cost of dyeing nylon. The dyed gray is dried and stretched through a tentering process to prepare a primary fabric (21) for tents.

To provide waterproof, fire retardant and ultraviolet inhibiting properties, a polyurethane coating layer (22) is coated on a surface of the primary fabric. The surface having the above coating layer faces to the interior of a tent. Usually, this coating layer is formed by a knife coating method with the presence of polyurethane, toluene (as a solvent), an ultraviolet inhibitor, a fire retardant agent and a water repellent agent. Thereafter, a water repellent (W/R) coating layer (23) is coated on the other surface of the fabric. The surface having the W/R coating layer is the opposing surface having the polyurethane coating layer. The W/R coating layer prevents the nylon primary fabric from hanging down during a rainy or snowy time.

The conventional fabrics for tents prepared with the above processes become discolored (i.e., yellow appearance) when exposed to ultraviolet rays for comparatively short time. The conventional fabrics have problems of color defects and have short lifetime. Moreover, the high cost and much time are necessary for the processes for preparing the conventional fabrics because of the dyeing process.

SUMMARY OF THE INVENTION

It is an object of the present invention to provide a fabric for tents and a process for preparing the same. The fabric consists of grays woven from nylon or polyester filaments and a layer of coating composition including polyurethane as a main component and an additional pigment, an ultraviolet inhibitor, aluminum powders, ceramic powders, a fire retardant agent and a solvent. The fabric can be protected from a yellowing appearance caused by ultraviolet rays and has a preferable color. The lifetime of the fabric can be extended. In addition, the comparatively low cost and short time are necessary for the process for preparing the fabric because the method of the present invention shortened the scouring process, and the dyeing process is not necessary in the present invention.

Additional objects, advantages and novel features of the invention will be set forth in part in the description which follows, and in part will become apparent to those skilled in the art upon examination of the following or may be learned by practice of the invention. The object and advantages of the invention may be realized and attained by means of the instrumentalities and combinations particular pointed out in the appended claims.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

In the following detailed description, only the preferred embodiment of the invention has been shown and described, simply by way of illustrating the best mode contemplated by the inventor(s) of carrying out the invention. As will be realized, the invention is capable of modification in various obvious respects, all without departing from the invention. Accordingly, the description is to be regarded as illustrative in nature, and not as restrictive.

DETAILED DESCRIPTION OF THE INVENTION

To achieve the above object, the present invention provides a fabric for tents comprising a gray and a polyurethane coating layer formed on the gray and made from a coating composition comprising polyurethane, a pigment, an ultraviolet inhibitor, aluminum powders, ceramic powders, a fire retardant agent and a solvent. It is preferable that the gray is made from polyester filaments, and that the coating composition comprises 40 to 50 weight part of polyurethane, 20 to 30 weight part of a pigment, 0.01 to 1 weight part of an ultraviolet inhibitor, 0.01 to 1 weight part of aluminum powders, 0.01 to 1 weight part of ceramic powders, 10 to 25 weight part of a fire retardant agent and 10 to 25 weight part of a solvent.

The present invention also provides a process for preparing a fabric for tents comprising the steps of mixing polyurethane, a pigment, an ultraviolet inhibitor, aluminum powders, ceramic powders, a fire retardant agent and a solvent to produce a coating composition and coating the coating composition on a gray.

DETAILED DESCRIPTION OF THE PREFERRED EMBODIMENTS

Representative Examples

Figure 1:
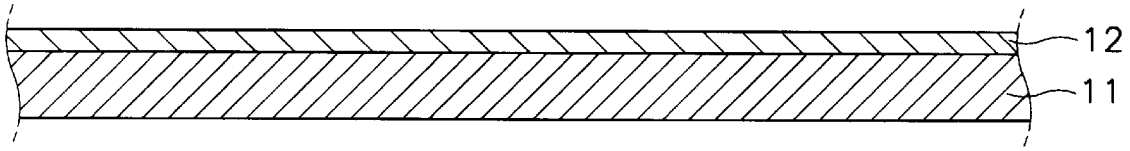
FIG. 1 is a cross sectional view of a fabric for tents according to the invention.
Figure 2:
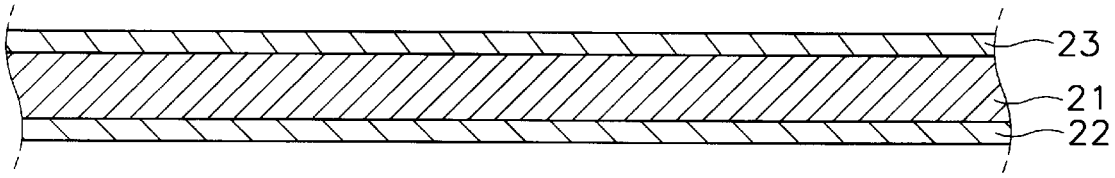
FIG. 2(Prior Art)
FIG. 2 is a cross sectional view of a conventional fabric for tents using a nylon as a primary fabric.
Figure 3:
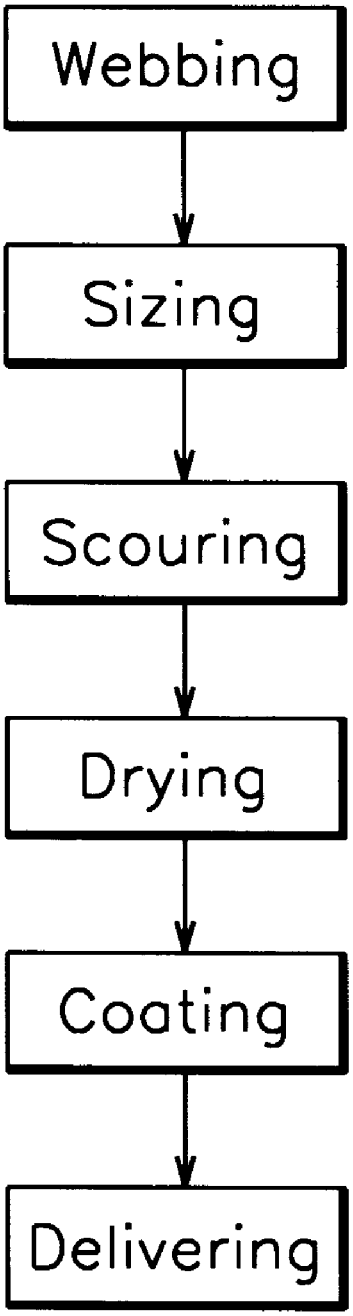
FIG. 3 is a flow chart showing a process for preparing a fabric for tents according to the present invention.
Figure 4:
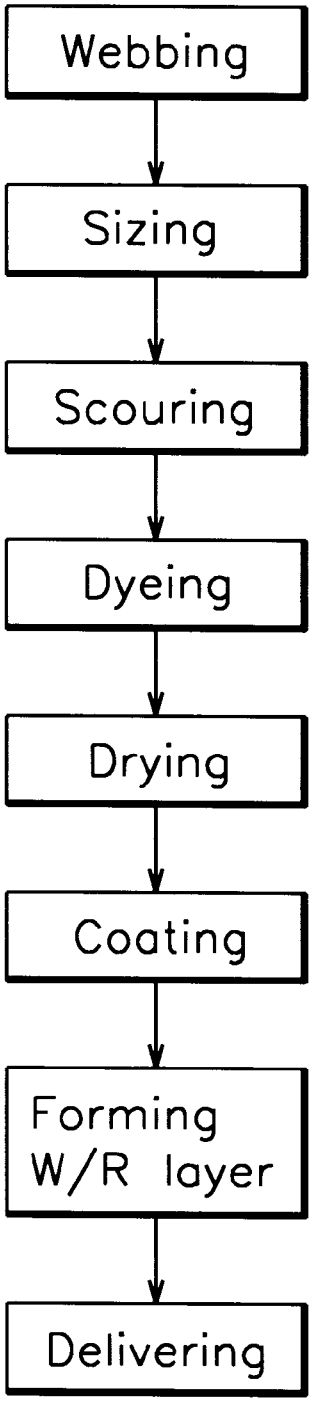
FIG.4(Prior Art)
FIG. 4 is a flow chart showing a conventional process for preparing a fabric for tents.

Compared with FIGS. 1 and 3, the process for preparing a fabric for tents according to the present invention is described below.

Preparation of a Polyurethane Coating Composition

The polyurethane coating composition for preparing the fabric for tents is prepared by the composition ratio of following Table 1.

TABLE 1

| | Composition Ratio (wt %) |
|---|---|
| Polyurethane | 40–50 |
| Pigment | 20–30 |
| UV Inhibitor | 0.01–1 |
| Aluminum Powders | 0.01–1 |
| Ceramic Powders | 0.01–1 |
| Fire Retardant Agent | 10–25 |
| Solvent | 10–25 |
| Additives (Softener, Cross linking Agent Hastening Agent) | 5–10 |

Preparation of a Fabric for Tents

A gray is prepared from nylon filaments or polyester filaments. Thereafter, the gray is scoured from sizing agents and other contaminants through a scouring process for about 18 hours. Then, the scoured gray is dried and stretched through a tentering process to prepare a primary fabric (11) for tents. The polyurethane coating layer (12) is coated on a surface of the primary fabric with the above polyurethane coating composition. The surface having the above coating layer faces to exterior of a tent. Usually, this coating layer is formed by a knife coating method.

Preferable Examples

A preferable working example and reference examples are described below. These examples are exemplary only, and the present invention is not restricted to the scope of the example.

Working Example 1

5500 yards, 75 denier of polyester filaments was applied to a sizing process and then prepared into a 190 T (90 strands of weft over 100 strands of warp) gray using water-jet weaving machine. In the sizing process, thickening agent, antistatic agent and oiling agent were added, and then the gray was scoured by dipping in sodium hydroxide (NaOH) for 4 hours. The scoured gray was adjusted to a tentering process to produce a primary fabric (11) at 180° C. A polyurethane coating layer (12) produced by a polyurethane coating composition prepared with mixing 42.1 weight part of polyurethane, 25.2 weight part of pigment, 0.03 weight part of ultraviolet inhibitor, 0.03 weight part of aluminum powders, 0.03 weight part of ceramic powders, 13.4 weight part of fire retardant agent, 13.4 weight part of solvent and 5.8 weight part of additives such as softener, cross linking agent and hastening agent was coated on a surface of the primary fabric through a knife coating method in a coating chamber at 120° C. to produce a fabric for tents according to the present invention.

In preferred embodiments, the pigment is a 1:1:1 ratio blend of su yellow CR-5, su red 6701, and su blue BL-1 by weight, each of which is available from Ilsam Company. The ultraviolet inhibitor is either one or a blend of u-F1, u-F2, or u-F3 from Union Chemical Company. An exemplary aluminum powder is available from Sama Aluminum Company under their AL-PASTE designation. The ceramic powder is available from Choyoung Ceramics Company under their Hicera designation.

The fire retardant agent is a blend of halogen compounds and phosphorous base compounds preferably in a 5:1 ratio halogen:phosphor. Exemplary halogen compounds are available from Ilsung Antimon Co. under their SB203 designation, and from Great Lakes Chemical Company under their BA59 designation. An exemplary phospor based compound is available from Hankook Fine Chemistries Co. under their P-72 Nica Gard designation. Methylethylketone (M.E.K.) and toluene act as appropriate solvents.

Reference Example 1

5500 yards, 70 denier of nylon filaments was applied to a sizing process and then prepared into a 190 T (90 strands of weft over 100 strands of warp) gray using water-jet weaving machine. In the sizing process, thickening agent, antistatic agent and oiling agent were added, and then the gray was scoured by dipping in sodium hydroxide (NaOH). After the scouring process, the scoured gray was dyed by elevating temperature to 40°, 60°, 80° and 100° C. with dyes (METAL COMPLEX; Teflon Co.). It takes 18 hours to dye the gray, and some amount of a water softener were used in the process. The dyed gray was adjusted to a tentering process to produce a primary fabric (21) at 180° C. A polyurethane coating layer (22), produced by a polyurethane coating composition prepared by mixing 61.18 weight part of polyurethane, 26.5 weight part of toluene as a solvent, 1.99 weight part of a fire retardant agent, and 5.33 weight part of additives such as softener, cross linking agent and hastening agent, was coated on a surface of the primary fabric through a knife coating method in a coating chamber at 120° C. Thereafter, a water repellent (W/R) coating layer (23) produced by a W/R coating composition comprising fluoride as a repellent agent was coated on the other surface of the fabric. The surface having the W/R coating layer is the opposing surface having the polyurethane coating layer.

Reference Example 2

5500 yards, 75 denier of polyester filaments were subjected to a sizing process and then prepared into a 190 T (90 strands of weft over 100 strands of warp) gray using water-jet weaving machine. In the sizing process, thickening agent, antistatic agent and oiling agent were added, and then the gray was scoured by dipping in sodium hydroxide (NaOH). After the scouring process, the scoured gray was dyed by elevating temperature to 40°, 60°, 80° and 100° C. with dyes (METAL COMPLEX; Teflon Co.). It takes 18 hours to dye the gray and some amount of a water softener were used in the process. The dyed gray was adjusted with a tentering process to produce a primary fabric (21) at 180° C. A polyurethane coating layer (22), produced by a polyurethane coating composition prepared by mixing 61.56 weight part of polyurethane, 24.65 weight part of toluene as a solvent, 8.84 weight part of a fire retardant agent, and 4.9 weight part of additives such as softener, cross linking agent and hastening agent, was coated on a surface of the primary fabric through a knife coating method in a coating chamber at 120° C. Thereafter, a water repellent (W/R) coating layer (23) produced by a W/R coating composition comprising fluoride as a repellent agent was coated on the other surface of the fabric. The surface having the W/R coating layer is the opposing surface having the polyurethane coating layer.

As shown in the above examples, the necessary time (about 4 hours) for the scouring process of the working example was shorter than that (about 18 hours) of the reference examples. Furthermore, the dyeing process was not included in the process of the working example, and thus almost 20 hours can be saved per 5500 yards in the whole processes. Additionally, the water repellent coating layer is not necessary for the fabric according to the working example, so the production cost and time for preparing it can be excluded in the process. Additionally, the fabric of the present invention has an extended lifetime.

The results of comparative tests for the fabrics for tents produced in the above examples are listed below.

TABLE 2

| | Color Fastness* (Grade) | Yellowing Appearance (Grade) | Preparing Time (hr/5500 yards) |
|---|---|---|---|
| Wok. Exam. 1 | 4–5 | 4–5 | 4 |
| Ref. Exam. 1 | 1-2 | 1-2 | 18 |
| Ref. Exam. 2 | 3 | 2-3 | 18 |

*Color Fastness was measured by a Xenon Weather-meter produced by ASTRA Company

The fabric of working example shows more preferable ultraviolet properties than that of the fabric of reference examples. As shown in the above results, the fabrics of the reference examples show a yellowing appearance after being exposed to a direct ray of light for about 3 to 4 weeks, but the fabric of the working example does not show the yellowing appearance for 4 to 5 weeks or more. Furthermore, the color fastness grade of the working example is 4–5, superior to the 1–2 grade of the reference examples.

In this disclosure, there is shown and described only the preferred embodiment of the invention, but, as aforementioned, it is to be understood that the invention is capable of use in various other combination and environments and is capable of changes or modification within the scope of the inventive concepts as expressed herein.

What is claimed is:

1. A fabric for tents comprising:

a gray; and a polyurethane coating layer formed on said gray and made from a coating composition comprising a polyurethane, a pigment, an ultraviolet inhibitor, aluminum powders, a ceramic agent comprising silica sol, aluminum oxide sol, and a liquid ceramic, a fire retardant agent and a solvent.

2. The fabric as claimed in claim 1, wherein said gray is made from polyester filaments.

3. The fabric as claimed in claim 1, wherein said coating composition comprises:

40 to 50 weight part of polyurethane;

20 to 30 weight part of a pigment;

0.01 to 1 weight part of an ultraviolet inhibitor;

0.01 to 1 weight part of aluminum powders;

0.01 to 1 weight part of a ceramic agent;

10 to 25 weight part of a fire retardant agent; and 10 to 25 weight part of a solvent.

4. A process for preparing a fabric for tents comprising the steps of:

mixing polyurethane, a pigment, an ultraviolet inhibitor, aluminum powders, a ceramic agent comprising silica sol, aluminum oxide sol, and a liquid ceramic, a fire retardant agent and a solvent to produce a coating composition; and coating said coating composition on a gray.

5. The process as claimed in claim 4, wherein said gray is made from polyester filaments.

6. The process as claimed in claim 4, wherein said coating composition comprises:

40 to 50 weight part of polyurethane;

20 to 30 weight part of a pigment;

0.01 to 1 weight part of an ultraviolet inhibitor;

0.01 to 1 weight part of aluminum powders;

0.01 to 1 weight part of a ceramic agent;

10 to 25 weight part of a fire retardant agent; and 10 to 25 weight part of a solvent.

* * * * *